US005081753A

United States Patent [19]

Fink et al.

[11] Patent Number: 5,081,753

[45] Date of Patent: Jan. 21, 1992

[54] APPARATUS FOR PRODUCING STAPLE-LIKE YARN FROM CONTINUOUS FILAMENT YARN

[75] Inventors: Roger H. Fink; Robert N. Armstrong, both of Asheville, N.C.

[73] Assignee: BASF Corporation, Parsippany, N.J.

[21] Appl. No.: 532,472

[22] Filed: May 31, 1990

[51] Int. Cl.[5] ..... D02J 3/02

[52] U.S. Cl. ..... 28/219

[58] Field of Search ..... 28/219

[56] References Cited

U.S. PATENT DOCUMENTS

| | | | |
|---|---|---|---|
| 2,003,400 | 6/1935 | Taylor et al. . | |
| 2,191,417 | 2/1940 | Woolley . | |
| 2,232,496 | 2/1941 | Thompson . | |
| 3,063,126 | 11/1962 | Tingas | 28/219 |
| 3,208,125 | 9/1965 | Hall et al. . | |
| 3,261,154 | 7/1966 | Michalek | 28/219 |
| 3,542,632 | 11/1970 | Eickoff . | |
| 3,645,080 | 2/1972 | Yamagata et al. . | |
| 4,019,311 | 4/1977 | Schippers . | |
| 4,191,010 | 3/1980 | Lehmann et al. . | |
| 4,674,271 | 6/1987 | Bird . | |

*Primary Examiner*—Werner H. Schroeder
*Assistant Examiner*—John J. Calvert

[57] ABSTRACT

A process for converting a continuous multifilamentary yarn into a staple-like yarn involves continuously conveying continuous multifilamentary yarn onto a rotatable wheel having a peripheral yarn receiving groove and at least one radially disposed needle within the wheel and in registry with the groove. The needles are in various stages of retraction and extension depending upon the relative rotational position of the wheel. By laterally contacting the multifilamentary yarn in the groove, the barbs of the needles catch and break a fraction of the filemants from the side of the yarn so that the yarn is not forced upward out of its grooved path.

12 Claims, 5 Drawing Sheets

APPARATUS FOR PRODUCING STAPLE-LIKE YARN FROM CONTINUOUS FILAMENT YARN

BACKGROUND OF THE INVENTION

This invention relates generally to processes for modifying textile fibers. More specifically, the present invention relates to apparatus for converting a continuously advancing multifilamentary yarn into a staple-like yarn.

A primary complaint regarding today's synthetic yarns is that their method of manufacture presents a product, though satisfactory from a dyeing and handling use, having a touch or hand when in final form that is less than satisfactory. The filaments are formed utilizing spinning apparatus which cause the surface of the filaments to be substantially smooth. For example, when formed into a garment structure, these smooth filaments have a tendency to be cold to the touch and generally lack the feel that one has become to expect from materials made of natural fibers, like cotton and wool.

In view of this drawback of synthetic filaments, yarn producers and garment manufacturers have sought to modify filament structures in a number of ways over the years. In one method, the yarns are cut into small segments called staple fibers and passed through apparatus such as open spinning machines which reform the staple fibers into a yarn. In the staple fiber yarn (sometimes referred to as spun yarn from the spinning operation) the ends of the various cut lengths protrude from the yarn, trapping air thus producing a feel more like the natural yarns the process attempts to simulate.

It has also been known to crinkle and twist the continuous filaments in a manner that causes the filaments to retain their contorted shape to some extent, and this texturing of the continuous filaments also tends to produce a warmer, less harsh feel than non-textured filaments.

Means for passing a barbed needle through a continuous multifilament yarn to abrade the yarn or break a small fraction of the filaments in the yarn has also been used to give the yarn a staple effect. Such an apparatus is shown in U.S. Pat. No. 4,674,271. The '271 apparatus requires intermittent passage of the yarn through the device. As disclosed in that patent, the lengthwise motion of yarn is stopped while a barbed needle is passed through the yarn. When the needle is retracted, the yarn is moved forward again. One drawback in this start/-stop method of simulating staple yarn is the resultant lost process efficiency.

An apparatus for continuously bulking yarn is disclosed in U.S. Pat. No. 3,208,125. Barbed needles project periodically from a wheel to displace (entangle) the filaments of a continuous filamentary yarn. It is disclosed that sometimes the needles break a filament to produce a yarn with the appearance of spun yarn. A major drawback of the apparatus is that the action of the needles on the yarn tends to lift the yarn from the path so that the needle does not pass completely through the yarn as is required for efficient entangling. It is necessary to appropriately tension the yarn in the needle path.

SUMMARY OF THE INVENTION

Accordingly, the present invention employs a barbed needle to pass preferably alongside a continuously moving supply of multifilamentary yarn. More preferably, the yarn is passed along a multiplicity of barbed needles while passing through the machine of the present invention.

It is an object of the present invention to provide an improved device for producing staple-like yarn from continuous multifilamentary yarn.

After reading the following detailed description, other objects and advantages of the present invention will become apparent to one who is ordinarily skilled in the relevant art.

DETAILED DESCRIPTION OF THE PREFERRED EMBODIMENTS

For the purpose of promoting an understanding of the principles of the invention, reference will now be made to specific embodiments of the invention and specific language which will be used to describe the same. It will nevertheless be understood that no limitation of the scope of the invention is thereby intended, such alterations and further modifications, and such further applications of the principles of the invention as discussed are contemplated as would normally occur to one skilled in the art to which the invention relates.

Figure 1:
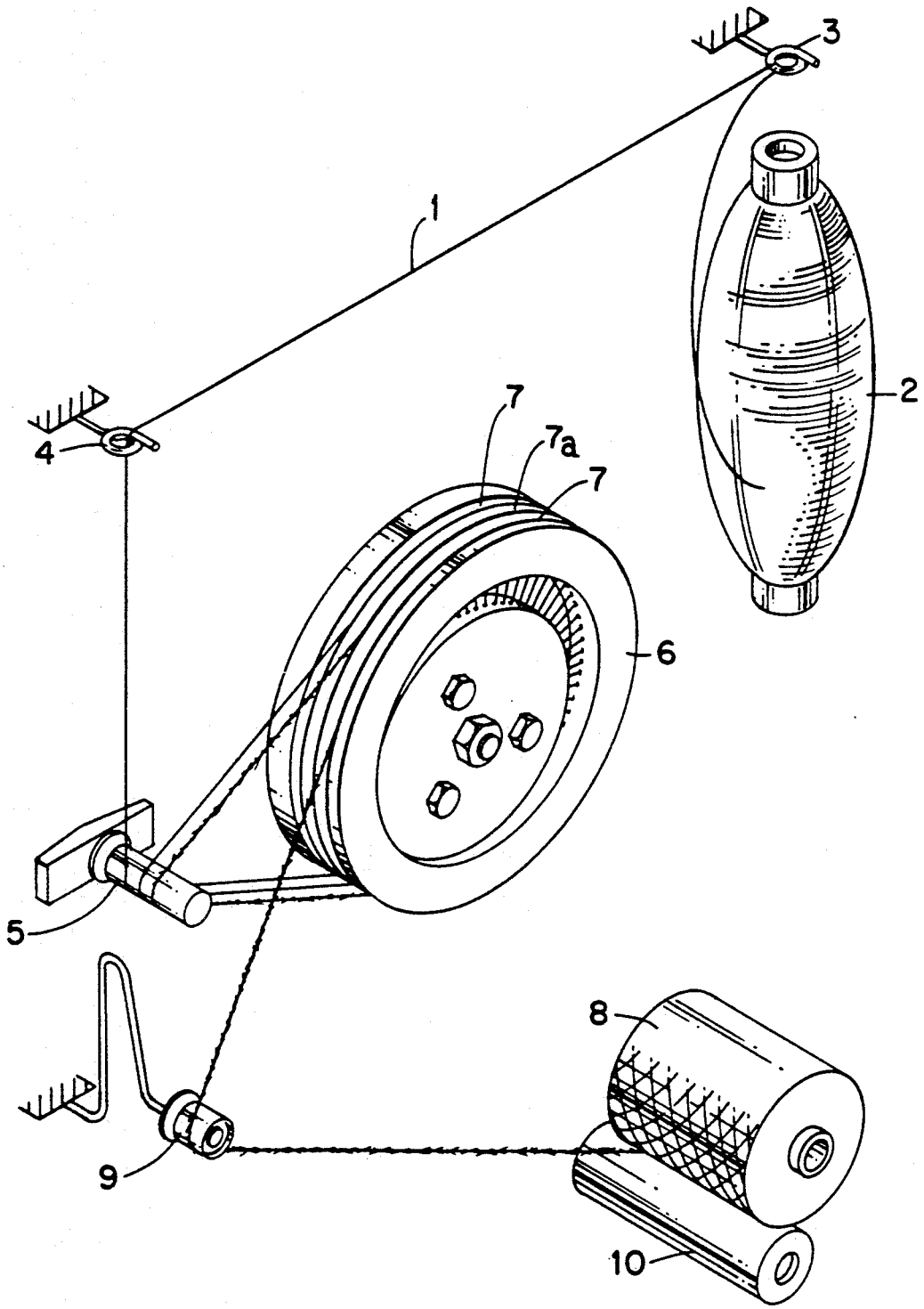
FIG. 1 is an overall schematic representation of a process utilizing the invention.

In the process of the invention as shown in FIG. 1, continuous multifilament yarn 1, which might be, for example, smooth, textured, bulked or crimped, may be continuously withdrawn from supply package 2. The withdrawn yarn passes through pigtail guide means 3 and 4 onto separator roller 5 before it is conveyed onto abrading wheel 6 shown generally in this figure. Grooves 7 in the abrading wheel direct the yarn in a particular path around the wheel and separator roll 5. The abraded (or staple-like) yarn is then withdrawn from wheel 6 and passed over dancer idler roll 9 and thereafter wound up into package 8 by conventional winding means 10.

Figure 1A:
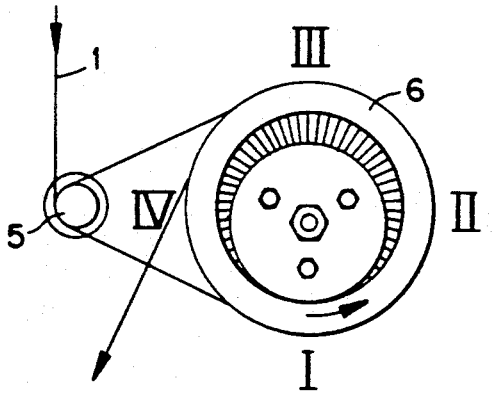
FIG. 1A is a side-view schematic of an abrading wheel of a first embodiment of the invention.
Figure 1B:
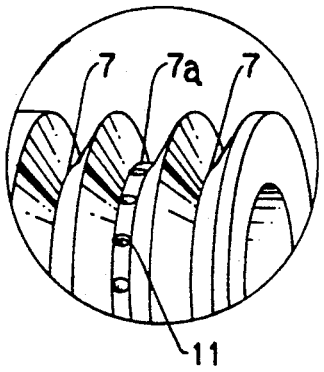
FIG. 1B is a detail showing the grooved portion of the abrading wheel of FIG. 1A.

Abrading wheel 6 is shown in more detail in FIG. 1A and FIG. 1B. Yarn 1 coming from the supply to separator roller 5 makes a multiplicity of passes through grooves 7 formed in the surface of wheel 6. In groove 7*a*, as depicted in FIG. 1B, there are openings 11 spaced equidistantly in the valley of groove 7*a*. Each opening 11 spaced at the bottom of groove 7*a* is of sufficient size to accommodate barbed needle 12 that is alternately forced up and down by a raceway positioned eccentrically to the rotation of abrading wheel 6 (see FIGS. 3–5). As shown, the grooves are of a size and shape sufficient to accommodate yarn 1 adjacent to needle 12.

Figure 2:
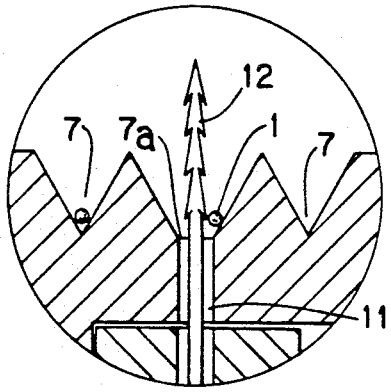
FIG. 2, FIG. 2A and FIG. 2B depict movement of a barbed needle as it passes up through the openings in the center groove of the abrading wheel of FIG. 1A.
Figure 2A:
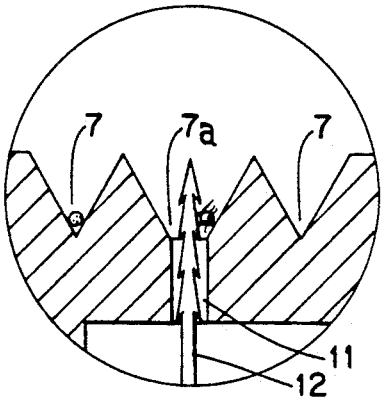
Figure 2B:
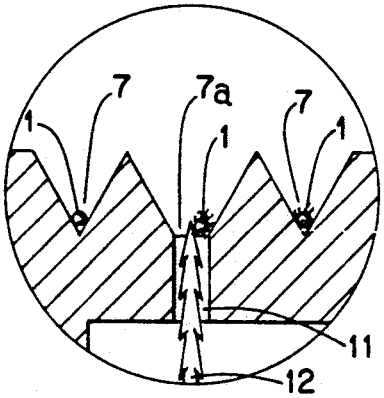
Figure 3:
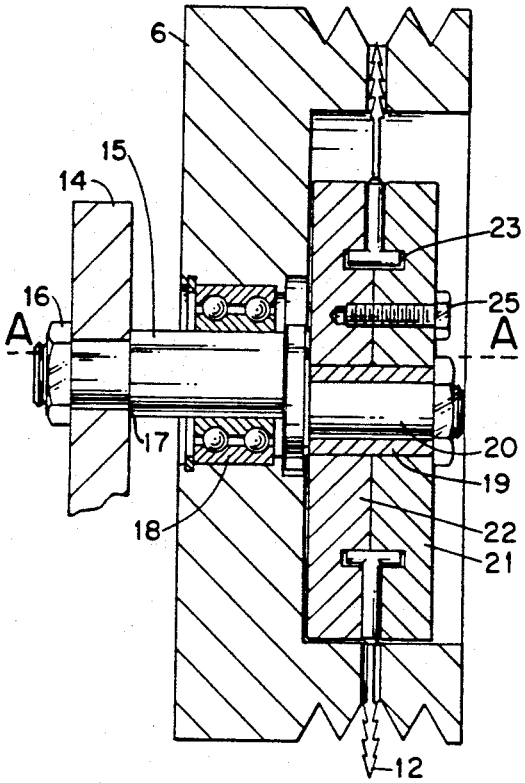
FIG. 3 is a sectional side view of one embodiment of the invention depicting the off center axis of the barbed needle race wheel.
Figure 5:
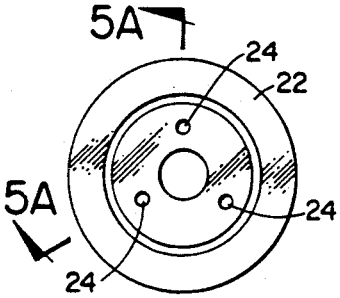
FIG. 5 depicts raceway discs for the needle wheel of FIG. 1A.
Figure 4:
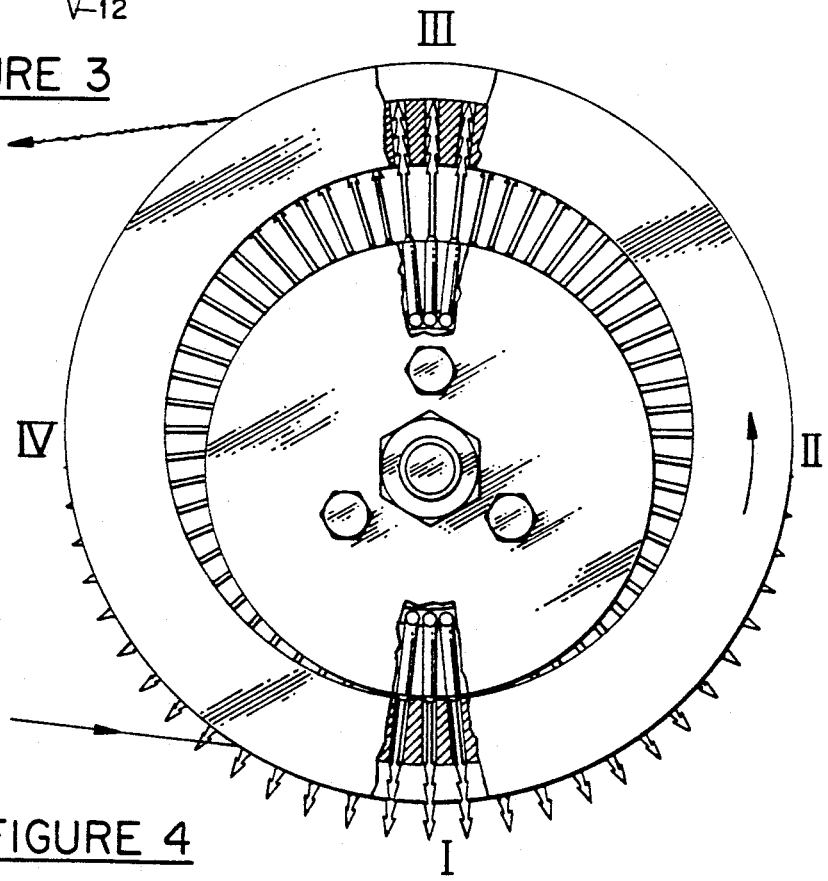
FIG. 4 is a partially cross-sectioned end view of the abrading wheel of FIG. 1A showing the operation of the barbed needles.

In operation, the movement of the barbed needles is controlled by the raceway and the relative positioning of the raceway to periphery groove 7*a* in its rotation about central axis A—A shown in FIGS. 3–5. This movement tightens up and forces the barbed needles alongside the yarn corresponding to their positioning in the raceway. The abrading wheel has four quadrants shown in FIG. 1A—position I, position II, position III and position IV. The relative positioning of the barbed needles in those quadrants is shown in FIG. 2, 2A and 2B respectively.

In FIG. 2 corresponding to position I, the barbed needle is shown fully extended and the yarn is just coming onto the wheel from separator roll 5. As the wheel rotates 90° to position II the eccentric raceway pulls the barbed needles downward through orifice 11. The needle barbs laterally contact the yarn, capturing individual yarn filaments from the side closest to the needle as the needle moves downward in the manner shown in FIG. 2A, breaking a portion of the filaments and thus abrading the yarn. As the wheel rotates another 90° into position III, the barbed needle is fully retracted leaving the abraded yarn in groove 7*a*, at which point the now abraded yarn returns to the sparator roller.

Further rotation to position IV moves the needles upward toward the full extension shown in FIG. 2. Thus the yarn makes more than one complete circumferential pass about the wheel. After the yarn has passed through the grooves of abrading wheel 6, it then passes to dancer roller 9 as depicted in FIG. 1 and onto winding package 8.

A first embodiment of the abrading wheel is shown in cross-section in FIG. 3 mounted to frame 14. Central arbor 15 is shown mounted to frame 14 by the use of nut 16 pulling the shaft portion extending through frame 14 up against step ledge 17 thereby fixedly attaching wheel 6 to the arbor. Abrading wheel 6 rotates about fixed central arbor 15 by bearing means 18. End 20 of arbor 15 is offset a determined amount from the rotational axis of the arbor and wheel 6. Shaft 20 has bearing bushing 19 press fit thereto. Bushing portion 19 supports two circular discs 21 and 22. The discs having T-shaped raceway 23 formed between them which acts as a guide for movement of needles 12. As needle 12 rotates with the movement of wheel 6, circular discs 21 and 22 rotate. The eccentric positioning of race 23 relative to abrading wheel 6 causes the inward and outward movement of the needles as they rotate with wheel 6.

It can be seen from FIG. 4 that this eccentricity of the raceway causes the needles to be in their outermost position at position I. The needles are withdrawn fully at position III as depicted in FIG. 4.

Figure 5A:
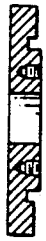
FIG. 5A is a cross sectional view taken along line 5A—5A of FIG. 5.

FIG. 5 and FIG. 5A are plan and side view depictions, respectively, of race disc 22. Screw hole 24 and screw 25 (FIG. 3) are one means for holding the discs 21 and 22 together. The discs may be positioned on shaft 20 through the use of key means, press fit or by other means which will affix the race discs stationarily to arbor 20.

Figure 6:
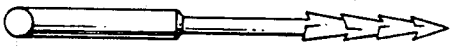
FIG. 6 and FIG. 6A depict typical barbed needles utilized in the invention.
Figure 6A:
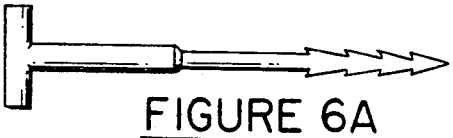

FIG. 6 and FIG. 6A depict typical barbed needles. These needles may be obtained from Foster Needle Company. The level of abrasion and the appearance of the resultant yarn may be adjusted based upon the configuration and size of the barbs.

Figure 7:
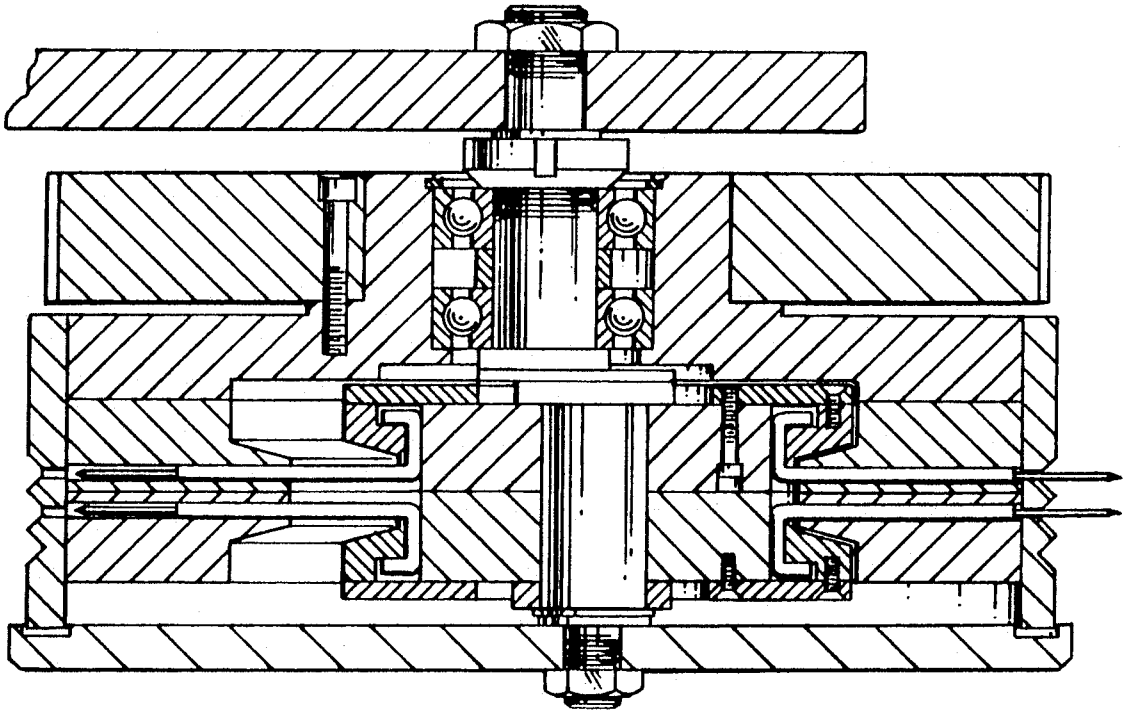
FIG. 7 and FIG. 8 depict an alternate embodiment of the abrading wheel using double barbed needle rows.
Figure 8:
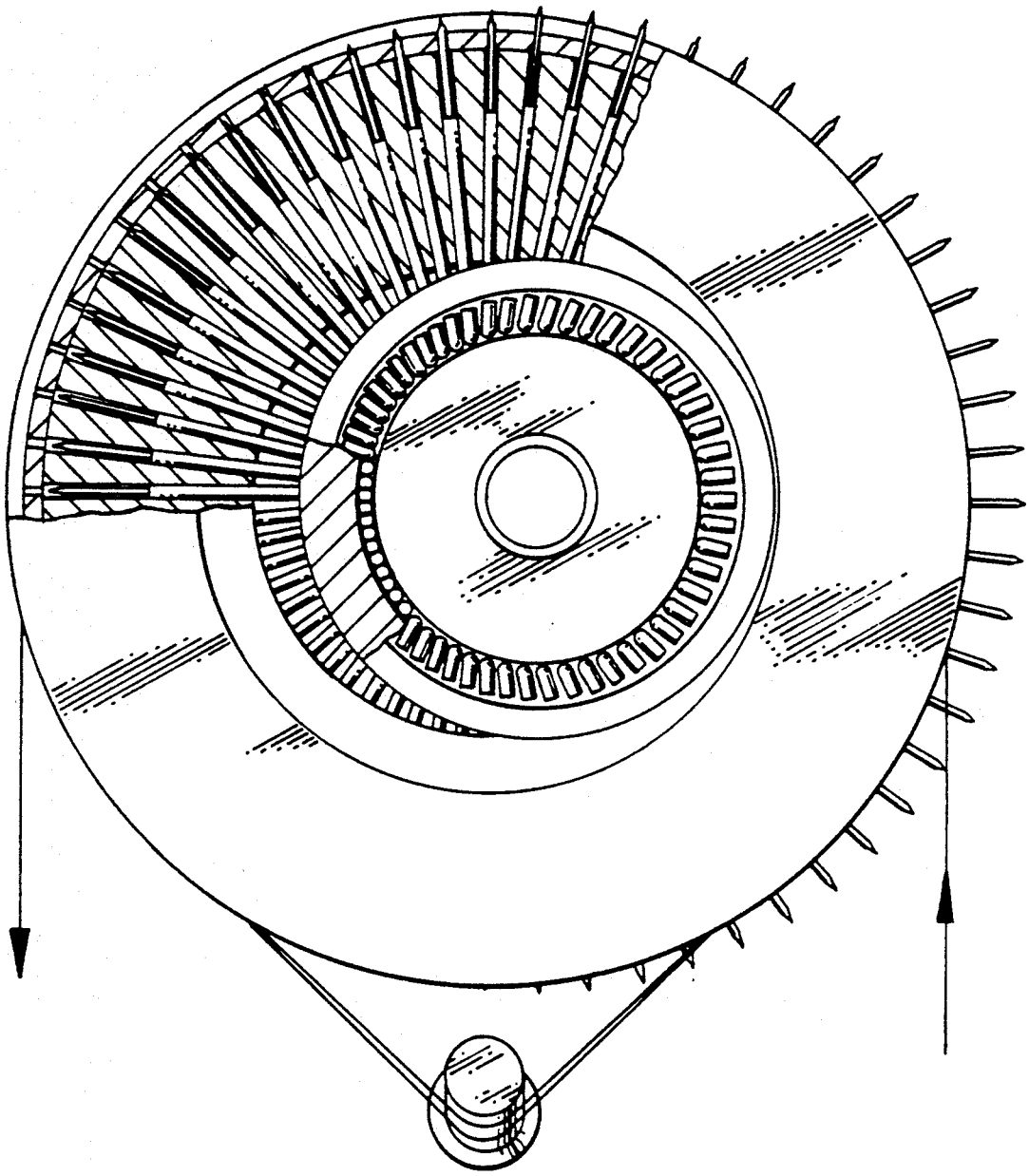

FIG. 7 and FIG. 8 depict a side-sectional view and an end partial sectional view, respectively, of an alternative embodiment utilizing paired barbed needles and are considered self-explanatory in view of the description above.

EXAMPLE

Two ends of nylon 6 multifilament carpet yarn, each having a total denier of 1800 and a filament count of 102, were abraded through the process of the present invention in FIG. 1. The yarns were plied and then heatset in a conventional manner through a Suessen Model GKK-6R and thereafter tufted into a 25-ounce first carpet section. An adjacent control carpet section of nylon 6 staple fibers (2.85/2), also Suessen heatset, were tufted.

In a second carpet, the 1800 denier 102 filament 2-ply end of nylon 6 multifilament carpet yarn was abraded through the process of the present invention and was tufted into a 40 ounce carpet. An adjacent control section was tufted of nylon 6 1800 denier 2-ply staple fiber.

In a third carpet, two ends of 1300 denier 68 filament nylon 6 yarn that had been abraded according to the present invention was tufted into a 25-ounce carpet. A conventionally texturized 1300 denier 2-ply 68 filament BCF yarn was tufted in an adjacent section as a control.

The carpets were compared side A to side B (side A being the yarn prepared according to the present invention and side B being the control) and rated on cover, bulk, brightness, tip definition and hand according to the following rating:

Rating

| | |
|---|---|
| +3 | Much better |
| +2 | Better |
| +1 | Slightly better |
| 1 | Equal |
| −1 | Slightly worse |
| −2 | Worse |
| −3 | Much worse |

The results of the visual comparison are set forth in Table 1 below:

TABLE 1

| Description | Carpet #1 | Carpet #2 | Carpet #3 |
|---|---|---|---|
| Cover | −1 | 0 | 0 |
| Bulk | −1 | +1 | −1 |
| Brightness | +2 | +3 | 0 |
| Tip definition | −1 | +1 | 0 |
| Hand | −1 | +1 | +1 |

This example illustrates the yarn subjected to the present invention is not deficient in sensory characteristics and in many cases has improved sensory properties.

What is claimed is:

1. In a process for converting a continuous multifilamentary yarn into a staple-like yarn by continuously conveying continuous multifilamentary yarn onto a rotatable wheel having a peripheral yarn receiving groove and one or more radially disposed needles, the one or more radially disposed needles within the wheel, in registry with the groove, and in various stages of retraction and extension depending upon the relative rotational position of the wheel, the improvement comprising:

laterally contacting in the groove the one or more radially disposed needles with said multifilamentary yarn, the one or more radially disposed needles, having barbs and the barbs catching and breaking a fraction of the filaments and restraining said yarn against upward movement in its grooved path.

2. The process of claim 1 wherein said catching and breaking occurs when the one of more radially disposed needles are retracting.

3. The process of claim 1 wherein the yarn makes at least one complete circumferential pass around the wheel.

4. The process of claim 1 wherein there are at least two radially disposed needles.

5. The process of claim 4 wherein the wheel has at least two peripheral grooves and said contacting takes place within at least two of the grooves.

6. The process of claim 1 wherein the groove is substantially v-shaped.

7. In an apparatus for converting a continuous multifilamentary yarn into a staple-like yarn by continuously conveying continuous multifilamentary yarn onto a rotatable wheel having a peripheral yarn receiving groove and at least one filament breaking means in various stages of retraction and extension within said wheel and in registry with said groove, the improvement comprising:

said filament breaking means being in registry with said groove and means for laterally contacting said yarn in said groove without piercing the center of said yarn.

8. The apparatus of claim 7 wherein said filament breaking means extends and retracts in said groove, said breaking means breaking said filaments as its retracts.

9. The apparatus of claim 7 wherein said breaking means includes at least one needle having barbs.

10. The apparatus of claim 9 wherein there are at least two barbed needles.

11. The apparatus of claim 10 wherein said wheel has at least two peripheral grooves and at least two of said grooves have one or more barbed needles disposed therein.

12. The apparatus of claim 7 wherein the groove is substantially v-shaped.

* * * * *

UNITED STATES PATENT AND TRADEMARK OFFICE

CERTIFICATE OF CORRECTION

PATENT NO. : 5,081,753

DATED : January 21, 1992

INVENTOR(S) : Roger H. Fink, Robert N. Armstrong

It is certified that error appears in the above-identified patent and that said Letters Patent is hereby corrected as shown below:

In the Abstract at line 11, please delete "filemants" and put --filaments-- in its place.

At column 3, line 30, please delete "sparator" and put --separator-- in its place.

Signed and Sealed this

Twentieth Day of April, 1993

*Attest:*

MICHAEL K. KIRK

*Attesting Officer*

*Acting Commissioner of Patents and Trademarks*